US005552968A

United States Patent [19]

Ladyjensky

[11] Patent Number: 5,552,968

[45] Date of Patent: Sep. 3, 1996

[54] CHEMILUMINESCENT LIGHTING ELEMENT

[75] Inventor: Jacques Ladyjensky, Brussels, Belgium

[73] Assignee: Omniglow Corporation, Novato, Calif.

[21] Appl. No.: 87,572

[22] Filed: Jul. 2, 1993

Related U.S. Application Data

[62] Division of Ser. No. 750,152, Aug. 26, 1991, Pat. No. 5,488,544.

[51] Int. Cl.[6] ..... F21K 2/00

[52] U.S. Cl. ..... 362/34; 206/219

[58] Field of Search ..... 362/34, 84; 206/219, 206/221; 126/263.05, 263.07; 62/2

[56] References Cited

U.S. PATENT DOCUMENTS

Re. 30,103 9/1979 Spector .
3,539,794 11/1970 Rauhut et al. .
3,674,028 7/1972 Ogle .
4,015,111 3/1977 Spector .
4,061,910 12/1977 Rosenfeld .
4,678,608 7/1987 Dugliss .
4,773,389 9/1988 Hamasaki .
5,067,051 11/1991 Ladyjensky .

FOREIGN PATENT DOCUMENTS

0406551A1 1/1991 European Pat. Off. .

*Primary Examiner*—James C. Yeung
*Attorney, Agent, or Firm*—Majestic, Parsons, Siebert & Hsue

[57] ABSTRACT

A chemiluminescent lighting element is disclosed comprising at least two chambers each containing one component of a chemiluminescent composition one of the chambers having walls of a nature or geometry such that exertion of external pressure on the element more easily reduces the volume of the one chamber than the other.

24 Claims, 2 Drawing Sheets

CHEMILUMINESCENT LIGHTING ELEMENT

This is a division of application Ser. No. 07/750,152, filed Aug. 26, 1991, U.S. Pat. No. 5,488,544.

BACKGROUND OF THE INVENTION

Lighting elements based on the chemiluminescent emission generated by the mixing of two liquids are already known.

The principle and the techniques for the production of chemiluminescent light are fully described in U.S. Pat. No. 4,678,608 which is incorporated in the present description as a reference.

The chemiluminescence is produced by reaction in the liquid phase of an activator such as hydrogen peroxide with a fluorescent agent and an oxalate. Other secondary compounds may also be present, generally fluorescent agents modifying the characteristics of the emitted light.

In addition to the very widespread chemiluminescent lighting elements that include one of the liquids in a glass tube capable of breaking and of thus expanding its contents into a chamber already equipped with the second liquid, there have more recently been put on the market chemiluminescent lighting elements with two distinct chambers, each made of a translucent synthetic material. These elements have the advantage of avoiding the use of glass.

Among these, there is one that consists of placing the liquids in a tube of transparent synthetic material in which a disk is placed transversely, separating the said tube into two chambers or compartments, each containing one of the liquids. Mixing takes place when there is caused, from the outside or the article, the rotation of the disk, which then lies flat and lets the liquids pass.

In general, the disk is given a diameter slightly greater than the internal diameter of the tube so that the wall of the tube, deformed elastically at right angles with the disk, exerts a centripetal pressure along the whole edge of the edge of the disk, thus ensuring tightness.

It has been found, surprisingly, that under certain conditions, it is sufficient to increase the pressure in one of the two chambers with respect to that prevailing in the other chamber, to cause rotation of the disk. In principle, if the centripetal pressure ensured by the elastic extension of the tube wall in the region in which it grips the disk is applied in a uniform and isotopic manner, the increase in pressure in one chamber as compared with the other will only have the effect of causing a displacement of the disk parallel to itself, not its rotation.

Without wishing to be bound to specific explanations, it is known that a goodly number of synthetic materials capable of constituting the tube wall actually do not show a perfect elastic behavior and therefore show a certain degree of plasticity. If, consequently, during installation of the disk in its transverse position, forces are exerted on the inner walls of the tube, at the point where the disk is supported, that are not uniformly distributed over the circumference, the edge of the disk may be driven more strongly into the wall at certain points than at others, and at least part of these differential indentations will remain permanently as a result of the plasticity. If a uniform hydraulic pressure is later exerted on one of the faces of the disk, it will not be displaced parallel to itself. The disk is actually driven further into the wall at certain points, which will show greater opposition to displacement, thus creating a torque causing rotation of the disk.

In another known embodiment, the adjacent chambers are separated by a plug, which is in contact on one side with the fluid present in the first chamber and on the other side with the fluid present in the second chamber. This plug yields when the pressure in the first of the two chambers appreciably exceeds that in the other chamber. This result can be obtained by making the first chamber more deformable than the other. When the whole of the element is immersed to a certain depth in water, it receives the required hydrostatic pressure. The use of this type of element, is of course, appreciated when one is looking for automatic lighting at a certain depth of immersion in the sea. Lighting outside water is also possible by manual compression of the deformable chamber.

SUMMARY OF THE INVENTION

The invention relates to a chemiluminescent lighting element consisting of at least two chambers of translucent synthetic material, each containing at least one chemical product capable of participating in a chemiluminescence reaction. The two chambers are separated by a disk, a plug, or a membrane capable of yielding, moving, or rotating under the action of an increase in pressure in one of the chambers, which permits the mixing of the two chemiluminescent components and the production of light. One of the two chambers has walls of a nature and/or a geometry such that the exertion of a pressure external to the object leads more easily to a decrease in the volume of said chamber than in that of the other chamber.

Preferably, said chambers are formed by the fitting together of three bowls that are separated by a partition wall crossed by a removable tightness plug, said plug being capable of yielding and moving under the action of a push exerted from the outside of the article on a flexible outer wall of one of the two chambers. The geometry of the flexible wall is conceived in such a way that, if it receives a uniformly distributed pressure, induced by a fluid in which the lighting element could be immersed, it will transmit the greater part of the force caused by this pressure to the plug, which is moved, thus permitting the mixing of the two liquids and the emission of chemiluminescent light.

THE DRAWINGS

DESCRIPTION OF THE INVENTION INCLUDING PREFERRED EMBODIMENTS

Figure 1:
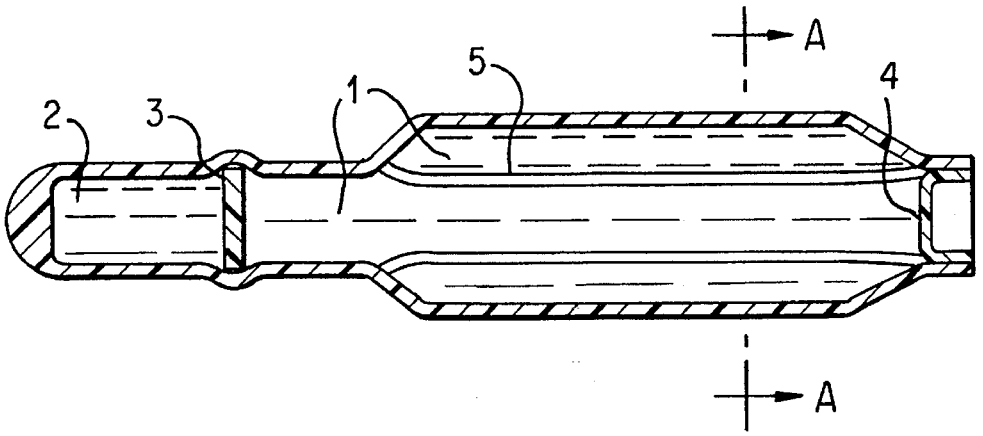
FIG. 1 represents a longitudinal, vertical section of a tubular element according to the invention.

The present invention provides the means so that, in a lighting element as described above, it will be easy to obtain a higher internal pressure in one chamber than in the other and so that this result will occur automatically when the lighting element is immersed, for example, into the sea.

It is actually of considerable economic interest to have available fishing lures that will light up automatically starting at a certain depth of immersion, after having been attached to the line in the unlit state before the actual fishing operation.

For classical lighting outside water, the present invention also makes it possible for the user to increase, by a very simple action, the internal pressure of one of the two chambers and thus to light the chemiluminescent element.

The present invention applies not only to the case of a tubular element separated into two compartments by the presence of a transverse disk, it relates to all elements containing two chambers separated by a tightness means capable of being released under the action of a pressure difference between the two chambers.

The article according to the invention therefore comprises two chambers of translucent synthetic material, which may be of various shapes. The two chambers may be joined by a tubular zone in which there is located a tightness means which, when the internal pressure prevailing in the first chamber exceeds that of the other chamber by certain threshold value, can move or rotate and thereby take on a position permitting the passage of liquid from one chamber to the other.

The tightness means may be a disk that rotates or a membrane that breaks. It may also involve a plug which, in the passive position, is in continuous peripheral contact with the inner wall of the tubular zone in which the geometry of the walls gripping it has become different and no longer provides the tightness contact.

To make it easier for a higher internal pressure to be present in the first chamber as compared with the other, it is provided that the volume of the first chamber can be more easily reduced than that of the second, under the effect of a pressure external to the article.

In most cases, this external pressure will be the hydrostatic pressure of water in which the article is immersed. The same effect may, however, be obtained outside water by a more or less local pressure exerted by the user, for example, by manual means.

To make it possible for the volume of the first chamber to be more easily reduced under the action of an external pressure, there are provided walls, which are both designed with respect to either their geometry, by giving them folds or embossing, or their thickness, or their nature itself, by executing the first chamber with more elastic walls than the second.

By modifying the above-mentioned characteristic, the articles can light up at pressures predetermined over a broad range of values. Thus, the article may enter into an active state starting at an excess pressure of 1 kg/cm$^2$, which corresponds to a depth of approximately 10 meters. By adapting the relative rigidities of the two chambers, the depth of lighting can be controlled up to values greater than 100 meters.

The embodiment that comprises providing a chamber with folded or embossed walls, while the other chamber—all things being equal as far as the thickness and material are concerned—has only smooth walls, is particularly economical. It actually makes it possible to execute the whole element by classical conventional molding.

The plug suitable for the chemiluminescent element according to the inventions may be a disk located transversely in the tubular zone and intended to rotate.

The plug may also have the form of a body of revolution of any desired generating line, with preference for an arc of a circle. In the passive position, this plug is completely in contact, over its circumference, with the inner wall of the tubular zone between the two chambers, with said wall being capable of exerting a centripetal pressure on the plug by elasticity in the assembly or not exerting such a pressure. Once it has been displaced along its axis by the pressure difference between the liquids of the two chambers, it is displaced into a broader zone, where it loses contact with the walls.

The plug—which can be made of any material whatever, as long as it has highly polished surface of revolution—as preferably given the shape of a keg, because this shape is capable of ready movement during the application of pressure.

The above-mentioned plug shows certain advantages over the disk. Thus, it can be made as small as desired, whereas the disk becomes difficult to rotate below a certain diameter. This makes it possible to provide for a small opening of communication that is also completely calibratable, which is an advantage. In fact, for certain applications, particularly for fishing, it is worth while for one of the two liquids, coming from the chamber at the higher pressure, to be incorporated into the other chamber gradually, because this contributes to a certain standardization of the rate of light emission with time. The desired rate can be controlled by acting on the calibration of the opening unblocked by the release of the plug and also by acting on the viscosity of the liquid.

According to a preferred manufacturing process for the chemiluminescent a element according to the invention, during construction of the article by molding starting with a thermoplastic synthetic material, the plug is first placed in the mold and the material to be molded is injected in the fused state into the mold, so as to be overmolded on the plug. This process, actually called "overmolding", is well known in the technology of thermoplastic materials. An excellent contact will be obtained between the molded synthetic material and the plug on the molecular level, because the fused material has "wetted" the peripheral surface of revolution of the plug. This results in better tightness between the two chambers and therefore in a high storage stability. The above-mentioned wetting can also be improved by the preliminary application of an appropriate "primer" to the plug. Of course, the surface of revolution of the plug should be polished and its material must not be susceptible to alteration by heat during the overmolding.

Another advantage of the article according to the invention shows up during storage of the article in its passive state before use. During this storage, which may last for months or even years, one of the liquid components has a tendency to release gas spontaneously and thus to cause a slight increase in its internal pressure. This can have an unfavorable effect on the tightness between the two chambers even if the threshold of pressure difference leading to release of this plug is not reached. Care must therefore be taken to place this liquid into the chamber whose volume or walls are the more expandable of the two.

The present invention also includes in a second embodiment, a chemiluminescent element which offers, as compared with the techniques of the prior art the following advantages:

It is more economical to manufacture.

It prevents any untimely lighting during handling, even rough handling, of the element before its use.

During immersed use in, for example, the ocean, it gives rise to a lighting operating at a more predictable movement and is therefore more reliable as far as the reproducibility is concerned.

It permits a better use of the force set in action to make the closing element yield, in such a way that this force can be greater and, through this fact, the plug can be kept in a more tightly gripping and therefore tighter state.

The article comprises of two adjacent chambers of translucent synthetic material, i.e. separated by a partition wall, itself made of synthetic material, preferably also translucent, with each of the chambers containing one of the reagents whose mixing must produce the chemiluminescent emission. The partition wall includes a closing element capable of yielding or moving under the action of an external force. The partition wall, is, for example, crossed by a short tubular pipe whose axis is perpendicular to it and in which is found a tightness element or plug with the shape of a body of revolution with an axis concentric with the pipe, which plug is therefore in contact with the contents of the first chamber on one side and with the contents of the second chamber on the other side. One of the outer walls of the one of the chambers is flexible and, when it receives pressure from the outside, it is transmitted to a rigid element in contact with the plug, which thus causes it to be released from the tubular pipe.

Furthermore, the closing element may be a membrane that is cemented, welded, or an integral part of the partition wall. This membrane is capable of being pierced or torn by the above-mentioned rigid element, which will assume a more or less sharp form.

The more deformable chamber takes on the appearance of a cylinder and the flexible wall is a bottom of this, therefore having the shape of an approximately flat circular disk and the rigid element is a small integral cylinder or truncated cone joined or attached to the center of this circular wall and with cross-section much smaller than the surface of the said wall. When it receives hydrostatic pressure, the induced force exerts an action that is concentrated essentially at the center of the wall and is thus taken up by the rigid element and transmitted to the plug. The latter thus receives a large part of the hydrostatic pressure multiplied by the surface of the wall and not only the hydrostatic pressure multiplied by the projected surface of the plug.

According to a preferred embodiment of the invention, the plug has the shape of a spherical ball with a polished surface. The nature of the material of the plug is not determining, provided that it is chemically compatible with the chemiluminescent liquids. Steel balls, which are particularly cheap articles, can be used advantageously.

The tubular pipe in which there is located the plug, for example, the ball may be of short length. It is necessary, however, that it provide a clamping zone on the circumference of the plug. This pipe can measure 1 to 3 mm in length. In an extreme case, the length of the tubular pipe could be limited to the thickness of the partition wall itself, with this pipe then comprising a simple circular hole in the partition.

To ensure good tightness, it is necessary that there be intimate contact between the plug and the tubular pipe, which can be obtained in several ways.

This result can be obtained, for example, by forcibly engaging the plug in the tubular pipe, which has been previously molded—by classical injection molding methods—to a diameter smaller than that of the plug. The insertion of the plug will therefore cause an elastic dilation of the tubular pipe, with pronounced clamping of its material on the plug; possibly with concomitant use of ultrasonic vibration in such a way that the forced insertion of the plug into the pipe causes a slight local fusion around the plug.

An intimate contact can also be obtained by placing, at the time of the injection molding, the plug into the mold and overmolding the synthetic material around the said plug, in such a way that this material, in the fused state, "wets" the plug and ensures a contact close to that of a gluing. If this is necessary, the plug may be provided with an adhesion primer; when the ball shape is adapted, the placement of a layer of primer on the balls is a particularly economical operation, using a mixing barrel.

It is preferred in that the force necessary to release the plug be as high as possible because, for obvious reasons, the expected tightness is indirectly related to its value. However, this force should not be greater than that which the user's hand is capable of providing or, in the case of immersion, greater than that resulting from the hydrostatic pressure on the flexible outer surface of the article. In this latter case, it is advisable, for this purpose, to optimize the variables constituting the geometry of the flexible wall: its surface, its thickness, etc. It must also have as extended a surface as possible, to collect more of the pressure, and its geometry must be such that the largest part of the force is transmitted at the point where the rigid element of transmission to the plug has been placed, generally in the center of the wall in question.

By adapting in an appropriate manner all of the geometric variables, not only those that have just been enumerated, but also the diameter of the ball, that of the tubular pipe—with this element inducing the degree of clamping—and, possibly, the length of the pipe, one will succeed in adjusting the depth of lighting to any desired value between 10 and 100 meters of sea water.

To protect the flexible wall from accidentally provided pressure that could occur during handling, preliminary to the use of the object, it is advantageous to provide a flange surrounding this flexible wall over its whole circumference, a flange whose outline is directed toward the outside of the object.

In order that a maximum amount of pressure be applied to the plug and to it only, it is also advantageous to provide a means that will prevent any deflection or deformation of the partition wall, whose ball is integral up to the moment at which an intervention is made to extract it. A preferential embodiment of such a means consists in providing behind the partition wall a series of transverse ribs, on the edge of which the partition wall rests, and which blocks any movement therefore in the direction of the pressure applied.

An economical method of production of the element according to the invention consists of inserting into each other three cylindrical bowls of approximately identical diameter, but with different depths. The first bowl, which is the deepest, will form the first chamber, and the second, of intermediate depth and driven into the first until their two edges are flush, will constitute the second chamber while its bottom will play the role of the partition wall between the chambers, the bottom being equipped with a plug. The third bowl, also inserted until its edge is flush with the two preceding edges, constitutes the lid of the assembly.

The bowl structure of this lid provides the protective flange mentioned above. The bottom of this third bowl constitutes the wall endowed with a certain flexibility, such as is provided by the present invention. After the operation of filling each chamber with a liquid to be reacted and insertion of the three bowls together, they are then welded along their common upper circumference. The advantage of this embodiment lies in the fact that the three bowls are economical moldings and, above all, that the assembly is limited to a single welding.

The invention will be better understood with reference to the attached drawings, illustrating a representative and non-limiting embodiment that will be commented on below.

Figure 2:
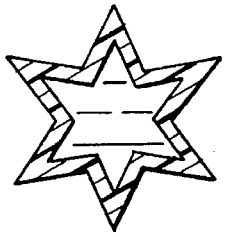
FIG. 2 represents a vertical section along AA of the element of FIG. 1.

FIG. 1 shows a tubular element of the invention consisting of a chamber 1 and a chamber 2, containing, respectively, a peroxide solution and a fluorescent agent. A disk 3 is wedged transversely into the tubular part, with the edge of the disk being in continuous contact with the interior of the tube wall, which is locally deformed and shows an annular blistering. The chamber 2 is closed by welding at end 4. Chamber 2 contains longitudinal folds 5, which can also be seen in FIG. 2, in a cross-section along the line AA of FIG. 1.

Figure 3:
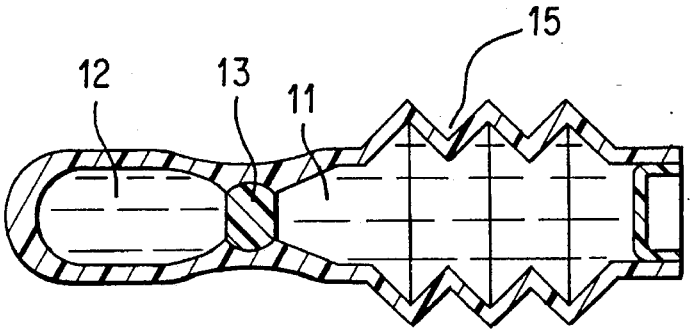
FIG. 3 represents a longitudinal, vertical section of a tubular element according to another embodiment.

FIG. 3 illustrates a tubular element also containing two chambers 11 and 12, one of which has an "accordion" structure with vertical folds 15. A keg-shaped plug 13 separates the two chambers and is surrounded by the walls in the application of an overmolding operation during manufacture of the element.

Figure 4:
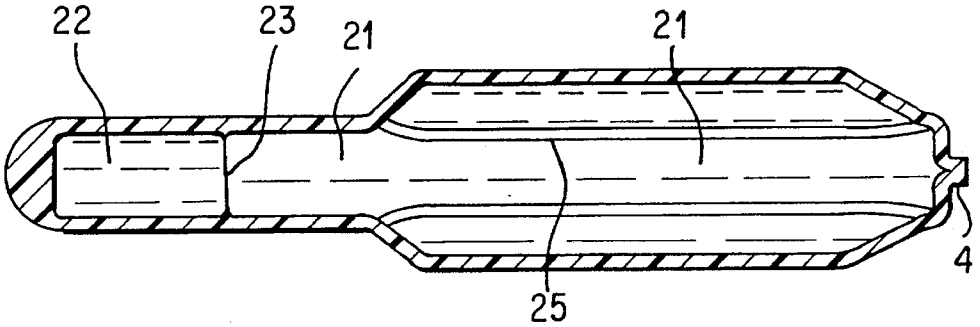
FIG. 4 represents a longitudinal, vertical section of a tubular element according to a third embodiment.

FIG. 4 illustrates a tubular element similar to that of FIG. 1, with the disk, however, being replaced by a membrane capable of breaking and the end 4 being closed by a process of direct welding of the flat walls.

Figure 5:
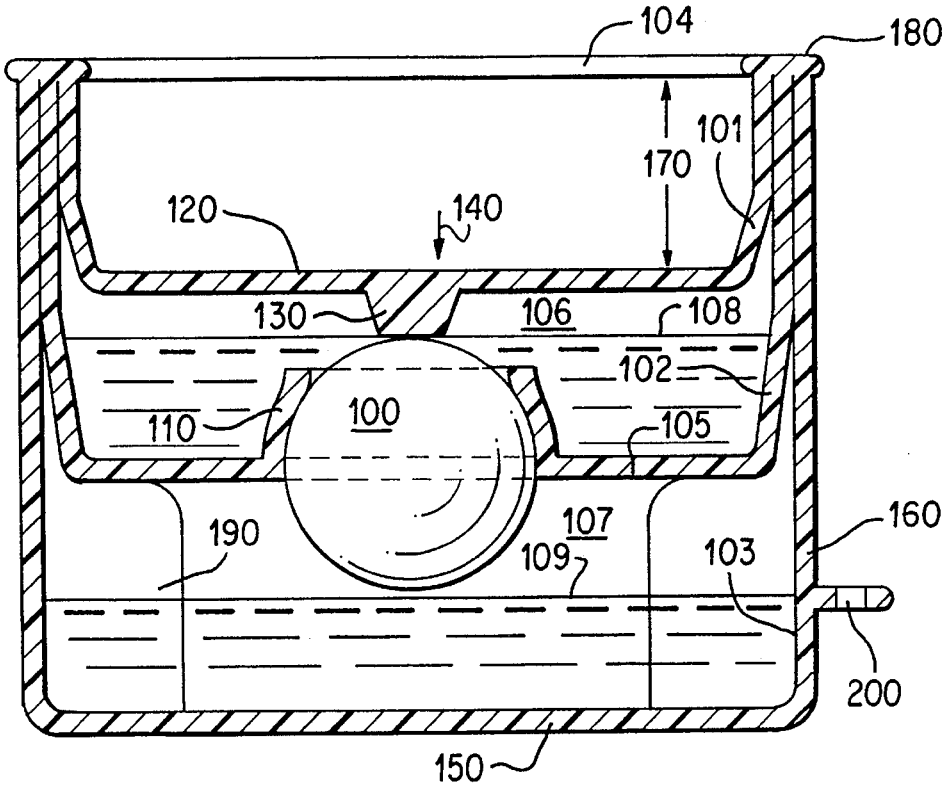
FIGS. 5 & 6 represent a vertical section of two versions of the chemiluminescent elements according to the invention.
Figure 6:
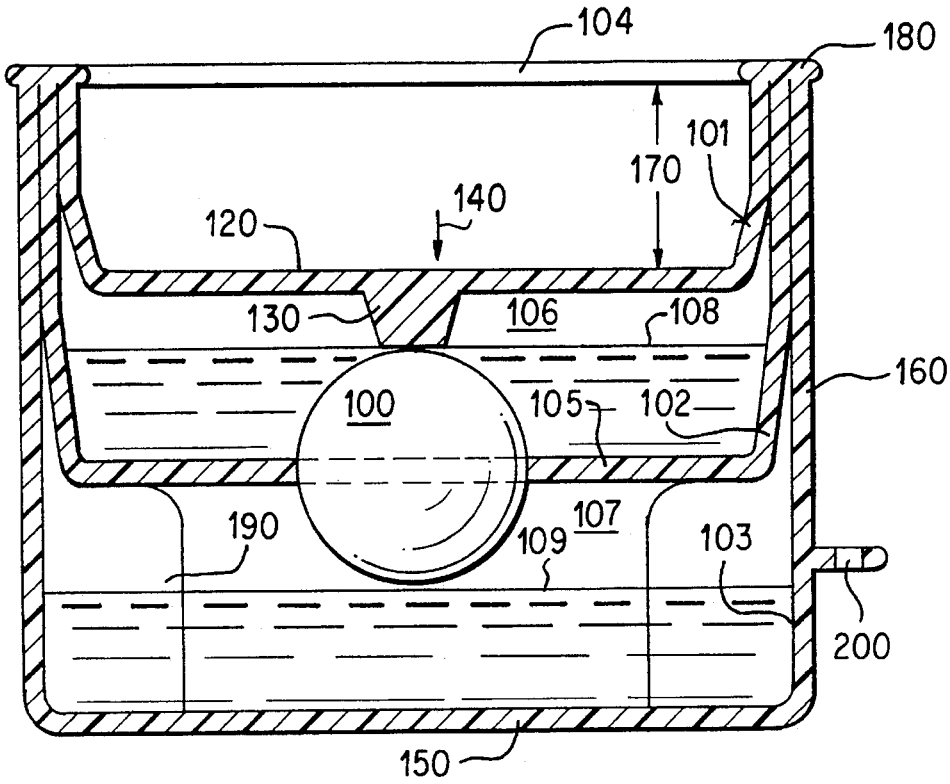

In FIGS. 5 and 6, the lighting element consists of three bowls 101, 102, and 103, injection-molded from translucent low-density polyethylene. These bowls are inserted into each other and are welded together in a tight manner along their common edge at 104.

The bottom 105 of the central bowl forms a petition wall between two chambers 106 and 107, which each contain a liquid capable of emitting chemiluminescence after mixing. Their respective levels are indicated schematically at 108 and 109.

The partition wall is provided with a ball 100 which is fitted into it, with strong clamping by the presence of a small tubular pipe 110 (FIG. 5) at the top half of the ball 100, which can also be omitted (FIG. 6) if the thickness of the partition wall is itself sufficient to ensure fitting of the ball. Tubular pipe 110 can also be extended to encase one or both sides of the lower half of ball 100, not shown.

The outer surface 120 is sufficiently flexible so that, under the action of a pressure applied to the element 130 located at its center, in the direction of the arrow 140, a slight movement of element 130 results, which element 130 is rigid by its geometry. This slight movement pushes the ball out of its housing, and the ball then falls into the chamber 107.

The pressure can be either that of the user's hand or that resulting from the hydrostatic pressure of the fluid into which the element is immersed with a particularly advantageous specific case being that of automatic lighting by the hydrostatic pressure of sea water. This hydrostatic pressure tends to deform the surface 120, in positive contact with the ball, which yields. On the other hand, the opposite surface 150, which also receives the hydrostatic push and also tends to yield, is less deformable and/or is too far from the ball to impart pressure to it. At most, it can transmit the hydrostatic pressure to the fluid of the chamber 107, resulting in the application to the ball of an opposing force with a maximum value equal to the said hydrostatic pressure multiplied by the projected surface of the ball i.e., much smaller than the pressure applied to the ball, by the action of the surface 120.

It is advantageous, although not essential, to give the side walls 160 and also the surface 150, a greater thickness as compared to the thickness of the surface 120. In this way, possible untimely deformations are reduced.

The upper bowl 101, which serves as a lid, has a depth 170 sufficient for its central element 130 to be protected against shocks and untimely pressure during handling preceding the use of the element.

This protection is further emphasized by the presence of the flange 180, which can be conceived in the geometry of the whole, or can be obtained very simply as a result of the welding operation itself.

The net diameter of access to the interior of the bowl 101 can be limited to that of the diameter of the user's finger, in the case of manual use of the element, and even smaller, in the case of use in automatic maritime lighting.

Reference 190 illustrates a particular embodiment in which there are provided transverse ribs of small thickness, for example, in the number of six arranged at 120°. These have the role of preventing the partition wall from bending under the action of the pressure which action is thus reserved for the ball itself.

Reference 200 shows an optional suspension ring, which has been molded with the bowl 103.

It is apparent that the arrangement according to the invention can be applied to uses other than the production of chemiluminescent light. The chemical compounds contained in the two compartments can have various useful applications and, in particular, are capable of producing heat, cold, or a glue for immediate use at the time of their mixing.

The articles according to the invention can contain more than two chambers, some of which may or may not contain identical components.

The articles according to the invention can also include a protective structure surrounding them and preventing accidental lighting during handling. This may involve, for example, an element of netting or a translucent, rigid, plastic envelope or partial envelope containing openings in such a way that the hydrostatic pressure on the chambers is not affected by the said protection. This protective structure may or may not be integral with the chemiluminescent element.

It us understood that numerous other variations can also be envisioned without going beyond the scope of the present invention.

We claim:

1. A chemiluminescent device made at least in part of translucent synthetic material and defining first and second chambers with each chamber containing at least one chemical product which reacts with the other to produce a chemiluminescent reaction, the first chamber having a first outer surface and the second chamber having a second outer surface, said chambers being separated by a partition wall having a closing element which is actuable under action on each chamber of a same coincident increase in external pressure of a medium in which said device is located to permit mixing of two or more chemical products that results in a production of light, the first outer surface adapted to receive pressure induced by the medium and to transmit force caused by this pressure to the closing element.

2. The chemiluminescent device as defined in claim 1 wherein said closing element comprises a plug.

3. The chemiluminescent device as defined in claim 2 wherein the first outer surface is more deformable than the second outer surface.

4. The chemiluminescent device as defined in claim 3 wherein the plug is spherical in shape and has a polished surface.

5. The chemiluminescent device as defined in claim 2 further comprising means for preventing deflection or deformation of the partition wall.

6. The chemiluminescent device as defined in claim 5 wherein said prevention means comprises one or more transverse ribs supporting said partition wall.

7. The chemiluminescent device as defined in claim 6 wherein the plug is spherical in shape and has a polished surface.

8. The chemiluminescent device as defined in claim 1 wherein the closing element comprises a removable tightness plug crossing the partition wall and wherein the tightness plug is positioned in a tubular pipe that is attached to said partition wall and has an axis that is perpendicular to the partition wall.

9. The chemiluminescent device as defined in claim 8 wherein the first outer surface is more deformable than the second outer surface.

10. The chemiluminescent device as defined in claim 9 wherein the plug is spherical in shape and has a polished surface.

11. The chemiluminescent device as defined in claim 8 further comprising means for preventing deflection or deformation of the partition wall.

12. The chemiluminescent device as defined in claim 11 wherein said prevention means comprises one or more transverse ribs supporting said partition wall.

13. The chemiluminescent device as defined in claim 12 wherein the plug is spherical in shape and has a polished surface.

14. The chemiluminescent device as defined in claim 1 wherein the first outer surface is adapted to receive pressure induced by the medium and to transmit force caused by this pressure to the closing element directly.

15. The chemiluminescent device as defined in claim 1 wherein the first outer surface is adapted to receive pressure induced by the medium and to transmit force caused by this pressure to the closing element via a rigid internal element that is in communication with the closing element.

16. A chemiluminescent device made at least in part of translucent synthetic material and defining first and second chambers with each chamber containing at least one chemical product which reacts with the other to produce a chemiluminescent reaction, the first chamber having a first outer surface and the second chamber having a second outer surface, said chambers being separated by a partition wall having a closing element in the form of a plug which is actuable under action on each chamber of a same coincident increase in external pressure of a medium in which said device is located to permit mixing of two or more chemical products that results in a production of light, the first outer surface being more deformable than the second outer surface and adapted to receive pressure induced by the medium and to transmit force caused by this pressure to the plug.

17. The chemiluminescent device as defined in claim 16 wherein the plug is spherical in shape and has a polished surface.

18. The chemiluminescent device as defined in claim 16 further comprising means for preventing deflection or deformation of the partition wall.

19. The chemiluminescent device as defined in claim 18 wherein said prevention means comprises one or more transverse ribs supporting said partition wall.

20. The chemiluminescent device as defined in claim 16 wherein the closing element comprises a removable tightness plug crossing the partition wall and wherein the tightness plug is positioned in a tubular pipe that is attached to said partition wall and has an axis that is perpendicular to the partition wall.

21. The chemiluminescent device as defined in claim 16 wherein the first outer surface is adapted to receive pressure induced by the medium and to transmit force caused by this pressure to the plug directly.

22. The chemiluminescent device as defined in claim 16 wherein the first outer surface is adapted to receive pressure induced by the medium and to transmit force caused by this pressure to the plug via a rigid internal element that is in communication with the plug.

23. A chemiluminescent device made at least in part of translucent synthetic material and defining first and second chambers with each chamber containing at least one chemical product, said products in said first and second chambers capable of reacting to produce a chemiluminescent reaction, said first chamber having a first outer surface and said second chamber having a second outer surface, said chambers being separated by a partition wall, said device comprising means for preventing deflection or deformation of the said wall, said wall having an aperture therein, said aperture having a closing element therein for normally closing off communication between said chambers, and said closing element responsive to an increase in external pressure on said first outer surface such that said closing element is actuated from a normally closed position to an open position thereby intercommunicating the chemical products in each of said chambers so as to produce chemical light.

24. The chemiluminescent device as defined in claim 23 wherein said prevention means comprises one or more transverse ribs supporting said partition wall.

* * * * *